US009179779B2

(12) United States Patent
Myre et al.

(10) Patent No.: US 9,179,779 B2
(45) Date of Patent: Nov. 10, 2015

(54) FURNITURE STABILIZING DEVICE

(71) Applicants: Jake Myre, Beaver Dam, WI (US); Laura Myre, Beaver Dam, WI (US)

(72) Inventors: Jake Myre, Beaver Dam, WI (US); Laura Myre, Beaver Dam, WI (US)

( * ) Notice: Subject to any disclaimer, the term of this patent is extended or adjusted under 35 U.S.C. 154(b) by 74 days.

(21) Appl. No.: 13/715,203

(22) Filed: Dec. 14, 2012

(65) Prior Publication Data

US 2014/0167482 A1 Jun. 19, 2014

(51) Int. Cl.
*A47C 31/00* (2006.01)
*A47C 7/00* (2006.01)
*A47C 9/00* (2006.01)

(52) U.S. Cl.
CPC ..... *A47C 7/002* (2013.01); *A47C 9/007* (2013.01)

(58) Field of Classification Search
CPC ..... A47C 7/002; A47C 9/007
USPC ..... 297/310, 463.1; 248/188.2, 440
See application file for complete search history.

(56) References Cited

U.S. PATENT DOCUMENTS

| | | | | |
|---|---|---|---|---|
| 484,657 | A | 10/1892 | Hammond | |
| 1,684,727 | A | 9/1928 | Cerny | |
| 1,732,872 | A | 10/1929 | Wittliff | |
| 1,752,545 | A | 4/1930 | Wittliff | |
| 3,215,382 | A * | 11/1965 | Stein | 248/172 |
| 3,952,983 | A * | 4/1976 | Crochet | 248/173 |
| 5,102,192 | A | 4/1992 | Barile, Sr. | |
| 5,226,439 | A | 7/1993 | O'Keeffe et al. | |
| 5,333,825 | A | 8/1994 | Christensen | |
| 5,409,296 | A | 4/1995 | Barile | |
| 5,490,715 | A | 2/1996 | Opsvik | |
| 5,513,900 | A | 5/1996 | Iglesias | |
| D452,190 | S * | 12/2001 | Harper | D12/128 |
| 6,478,267 | B1 * | 11/2002 | Whitman et al. | 248/157 |
| 6,567,997 | B2 | 5/2003 | Harper | |
| D487,977 | S | 4/2004 | Hill | |
| 6,877,817 | B1 | 4/2005 | Brown | |
| D564,867 | S | 3/2008 | Levin | |
| 7,452,029 | B2 * | 11/2008 | Ference | 297/183.6 |
| 7,681,847 | B2 | 3/2010 | Levin | |
| 7,722,118 | B2 | 5/2010 | Bapst et al. | |
| 7,891,629 | B2 | 2/2011 | Moyers | |
| 2007/0170760 | A1 | 7/2007 | Peterson | |
| 2012/0181823 | A1 * | 7/2012 | Brunner | 297/188.01 |

OTHER PUBLICATIONS

"Little Partners Learning Tower," printout dated Jun. 7, 2013 from http://www.littlepartners.com/the-learning-tower/.
"Amazon.com: Chair Locks for Child Safety, 4 pack: Baby," printout dated Jun. 7, 2013 from http://www.amazon.com/Chair-Locks-Child-Safety-pack/dp/B003TMS0A8/ref=pd sxp.

* cited by examiner

*Primary Examiner* — Philip Gabler
(74) *Attorney, Agent, or Firm* — Boardman & Clark LLP

(57) ABSTRACT

The present disclosure is generally directed to a system that may be coupled to and is compatible with various sizes and types of furniture including chairs and stools with individual legs, to help stabilize such furniture by outwardly expanding at least a portion of the footprint of the furniture to which the system is coupled, by separating the tipping axes of the furniture and the system coupled to the furniture, and/or by increasing the tip resistance of the chair by coupling it to the system.

11 Claims, 5 Drawing Sheets

FURNITURE STABILIZING DEVICE

BACKGROUND

The present invention relates in general to furniture with individual legs, such as chairs and stools, and more particularly, to a system that helps stabilize furniture with individual legs, such as a chair or stool with individual legs. Most chairs, and especially dining room, kitchen, patio, and other types of chairs and stools, such as those for sitting at a kitchen countertop, breakfast bar, or other bar area, are prone to tipping and/or tipping over. In some cases, when a chair is slid, one or more of the ends or feet of the chair legs has a tendency to catch (e.g., on an uneven surface) and cause or encourage the chair to tip. In addition, children and others who occupy such chairs will at times lean back or push away from another object (e.g., a fixture such as a cabinet, countertop, or wall) which can also cause or encourage the chairs to tip. The occupants of such chairs can be injured when the chairs tip over. In addition, the chairs and/or the area surrounding the chair can be damaged.

A few devices for improving the stability of chairs or the like are known in the art. For example, U.S. Pat. No. 5,513,900 to Iglesias discloses a set of chair stabilizing devices for rotatable attachment to the base of a lawn or beach chair to prevent sinking in sand or tipping over in sand or uneven surfaces. However, the operation, structure, and mechanism involved with this set of devices is different from the present invention. For example, a gripping member included with each device in the set appears designed to receive a horizontally extending leg member portion of that particular type of chair.

U.S. Pub. No. 2007/0170760 to Peterson discloses a device for preventing tipping over of a chair that includes individual legs. More specifically, the device appears to include a leg member, a support foot attached at an angle to the leg member, and clamps to secure the device on the back legs of the chair with individual legs. The leg member appears to be secured such that when the chair is tilted back the bottom portion of the support foot will prevent the chair from tipping further. However, the operation, structure, and mechanism involved in this device are different than the present invention. While devices, such as those described above, have been developed for increasing the stability of chairs, a solution for preventing tipping over of existing chairs still needs to be provided. There is a need to provide a device or system that stabilizes furniture, including chairs, with individual leg members to make the furniture less likely to tip over when a lateral force is applied. There is also a need to provide a stabilizing device that can be retrofitted to myriad shapes and sizes of furniture with legs. There is also a need to provide a simple, aesthetically pleasing solution for preventing tipping of such furniture and chairs. In addition, there is a need for a stabilizing device that prevents tipping of furniture and chairs without creating a substantial trip hazard. In addition, there is a need for such a device that is removable, easily installed, and easily retrofitted to furniture, including chairs, without the need for tools.

SUMMARY

The present disclosure relates to a furniture stabilizing system, the system comprising a base having a first planar surface adapted to support a piece of furniture having multiple feet provided on the base; and a first strap operatively coupled to the base and adapted to be removably provided at least partially around at least one component of the piece of furniture.

The present disclosure further relates to a device for preventing furniture from tipping over, the device comprising a base having a base footprint dimension and adapted to be coupled to a piece of furniture having a furniture footprint and a furniture footprint dimension; and a first strap operatively coupled to the base and adapted to be provided around at least one component of the piece of furniture; wherein the base footprint dimension is greater than the furniture footprint dimension.

The present disclosure further relates to a chair comprising a plurality of leg members provided on a first planar surface of a substantially planar base coupled to the chair, wherein the base has a thickness less than one inch.

BRIEF DESCRIPTION OF FIGURES

The disclosure will be better understood, and features, aspects and advantages other than those set forth above will become apparent when consideration is given to the following detailed description thereof Such detailed description makes reference to the following drawings, wherein.

Figure 1:
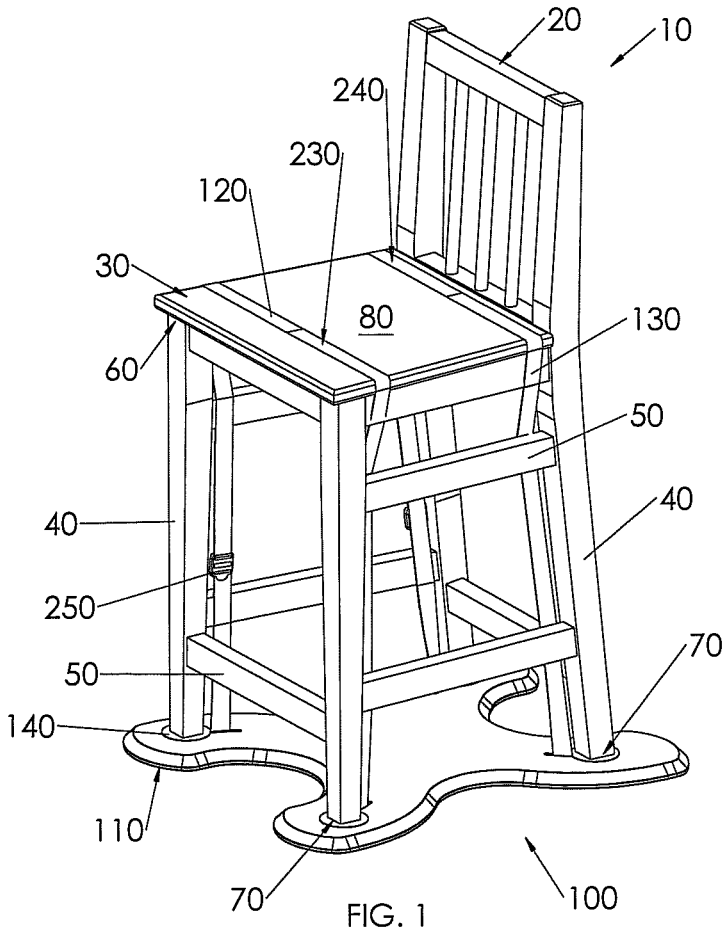
FIG. 1 is an isometric view of a furniture stabilization system, coupled to a chair, according to one or more examples of embodiments.

While the disclosure is susceptible to various modifications and alternative forms, specific embodiments thereof have been shown by way of example in the drawings and are herein described below in detail. For example, any numbers, measurements, and/or dimensions illustrated in the Figures are for purposes of example only. Any number, measurement or dimension suitable for the purposes provided herein may be acceptable. It should be understood that the description of specific embodiments is not intended to limit the disclosure from covering all modifications, equivalents and alternatives falling within the spirit and scope of the disclosure.

DETAILED DESCRIPTION

Unless defined otherwise, all technical and scientific terms used herein have the same meaning as commonly understood by one of ordinary skill in the art to which the disclosure belongs. Although any methods and materials similar to or equivalent to those described herein may be used in the practice or testing of the present disclosure, example methods and materials are described below.

Referring to the drawings, example embodiments of a furniture stabilization system and device that prevents tipping of furniture, such as a chair with four individual legs, is illustrated. Referring to FIGS. 1-4, a furniture stabilization system 100 coupled to a chair or stool 10 is shown.

In various embodiments, furniture stabilization system 100 is adapted to be removably coupled, removably fastened, and/or removably mounted to a chair or stool 10, as shown by way of example in the Figures. For example, the Figures illustrate a kitchen chair or stool 10 having a number of components including a seatback member 20, a seat member 30, multiple leg members 40, and one or more rungs 50, fastened otherwise coupled together to form chair or stool 10. The chair or stool may also include arm rests, coupled to the seat member and/or seatback member. As shown in the Figures, leg members 40 include a proximate section end or section 60 provided near (or, in some cases, above) seat member 30 and a distal end or foot 70. While the figures illustrate the utilization of the system with chair or stool 10, it should be appreciated that the system may be utilized with other types of chairs or stools (e.g., movable seating typically used in kitchens, dining rooms, classrooms, audience seating, whether for indoor, outdoor, household or commercial use, or other types of furniture).

Furniture stabilization system 100 includes a base 110. In various embodiments, furniture stabilization system 100 also includes a first strap 120 operatively coupled to base 110 and adapted to be removably threaded or otherwise provided around or through a portion of stool or chair 10. In various embodiments, furniture stabilization system 100 includes a second strap 130 adapted to be removably threaded or otherwise provided or through around a portion of chair 10. In various embodiments, furniture chair stabilization system 100 further includes pads 140 (e.g., rubber pads) provided between and/or adapted to be provided between distal end 70 of one or more leg members 40 and base 110. In various embodiments, pads 140 are adhesive backed rubber pads to help prevent distal end or foot 70 from slipping or sliding relative to base 110 when base 110 is supporting chair or stool 10.

Referring now to FIGS. 5-9, in various embodiments, base 110 is fabricated from a rigid or substantially rigid material, and may be resistant to impact and deformation. Examples of suitable materials for fabrication of the base include various grades of wood plywood, composite material, plastic, metal, and/or combinations thereof. In various embodiments, the base may be manufactured through a variety of known methods, including injection molding, CNC machining, and/or metal stamping. While shown as a single piece of material, the base may be fabricated by multiple materials or pieces. For example, the base may include two pieces coupled by hardware such as a hinge such that the base can be folded or otherwise broken down for ease of shipping and/or storage.

In various embodiments, base 110 includes a top surface 150 (e.g., a planar top surface) and a bottom surface 160 (e.g., a planar bottom surface), and a thickness or height "T." Thickness or height T (e.g., average thickness or height or maximum thickness or height) of base 110 depends in part on the innate rigidity and/or weight of the material or materials of base 110. In various embodiments, thickness or height T of base 110 is selected to provide a suitable or desired balance between the rigidity and thickness or height T of base 110. In various embodiments, base 110 is less than about one inch in thickness or height T. In various embodiments, base 110 is about three quarters of an inch in thickness or height T. In various embodiments, the height or thickness T of base 110 is intended to be less than one inch to help minimize any increase in height on a typical chair 10, stool, or other furniture, coupled to furniture stabilization system 100. The height or thickness T of base 110 may be less than one inch to prevent base 110 from being a tripping hazard. In various embodiments, however, thickness or height T may be more than one inch (e.g., to help boost height of furniture coupled to the base).

In various embodiments, base 110 includes an upper edge 170 and a lower edge 180. In various embodiments, upper edge 170 is a perimeter of top surface 150, and/or lower edge is a perimeter of bottom surface 160. In various embodiments, base 110 tapers from or between lower edge 180 to upper edge 170 to help prevent base 110 from being a tripping hazard. In various embodiments, any corners of base 110 are rounded or otherwise softened (e.g., to reduce tripping risk and/or injury).

In various embodiments, base 110 defines one or more slots, slits, or other apertures 190 adapted to receive at least a portion of the first strap and/or the second strap. In various embodiments, base 110 further defines a recess 200, around one or more slots 190, that is sized and adapted to receive a slide (not shown) of a strap assembly (not shown) to help prevent the slide from contacting a floor surface on which base 110 is provided. In various embodiments, each recess 200 and/or slot 190 are sized and/or shaped to allow a slide to be positioned and/or provided anywhere along slot 190 to better align with the strap the slide is adapted to receive and/or a point near a distal end of a leg member. In various embodiments, bottom surface 160 and/or base 110 defines one or more pad recesses 210. In various embodiments, pad recesses 210 are adapted to partially receive one or more pads or gliders (not shown) that may be coupled or adhered to bottom surface 160.

Referring again to FIGS. 3-4, in various embodiments, furniture stabilization system 100 includes one or more pads or gliders 220 provided near one or more margins of base 110 (e.g., in recesses in bottom surface 160). The pads may be made of any material, but, in various embodiments, pads 320 are made of felt, or the like, to protect (e.g., from scratches) a floor on which base 110 sits or is otherwise provided and/or to allow system 100 and base 110 to slide along the floor, instead of tipping, when the system or the chair are subjected to a lateral force.

In various embodiments, the one or more pads 220 have a relatively low profile beyond the bottom surface 160. For example, a pad 220 may protrude beyond bottom surface 160 from about one thirty-secondth to about one-eighth of an inch. In various embodiments, pads 220 may protrude beyond bottom surface 160 approximately one sixteenth of an inch.

In one or more examples of embodiments, the furniture stabilization system may include one or more wings that may be coupled and extend from the base (e.g., to the rear, to one or both sides, etc.) to further stabilize a piece of furniture coupled to the furniture stabilization system.

Referring again to FIGS. 1-4, in various embodiments, first strap 120 and/or second strap 130 are flexible (e.g., to allow one or both straps 120/130 to conform to a chosen installation route) and are low profile to minimally protrude above or beyond seat member 30 when the system is installed or otherwise coupled to chair or stool 10. It should be appreciated that other types of tension-carrying materials including webbing, rope, and the like, may be used in place of any strap.

Figure 3:
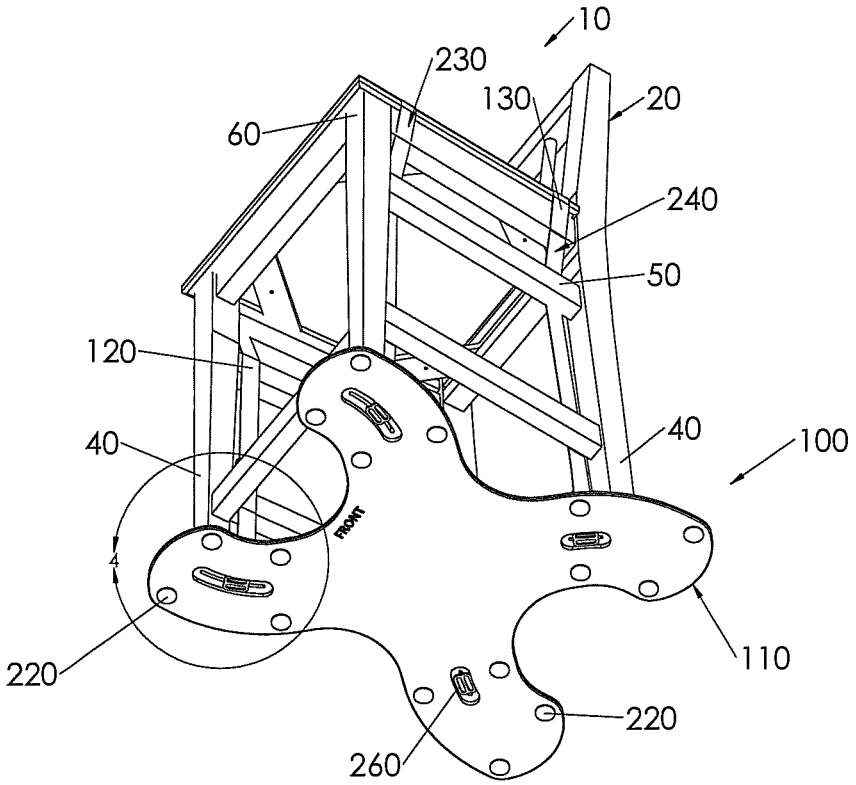
FIG. 3 is an isometric view of a furniture stabilization system and chair, according to one or more examples of embodiments.
Figure 4:
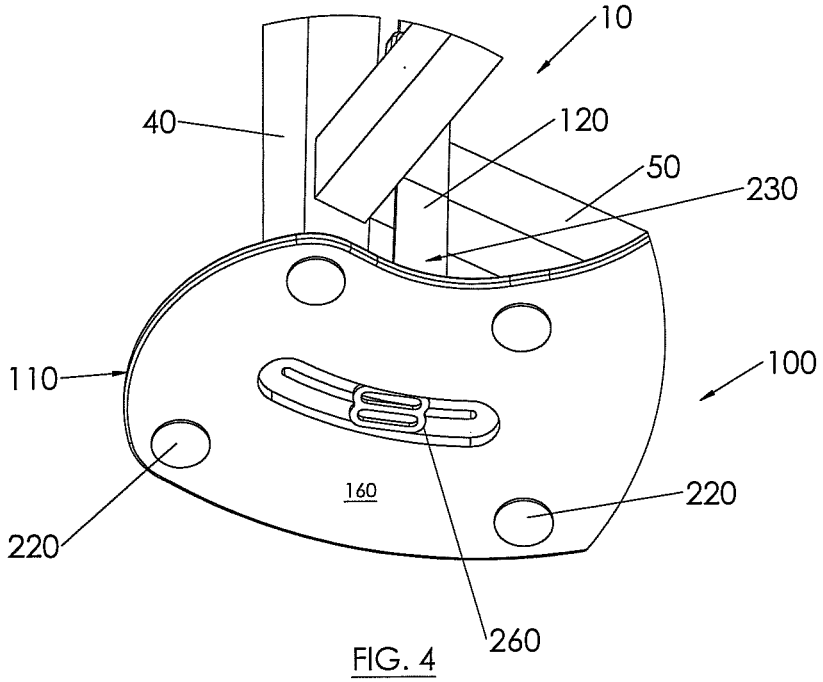
FIG. 4 is a detailed view of a portion of the chair stabilization system and chair shown in FIG. 3, according to one or more examples of embodiments.
Figure 5:
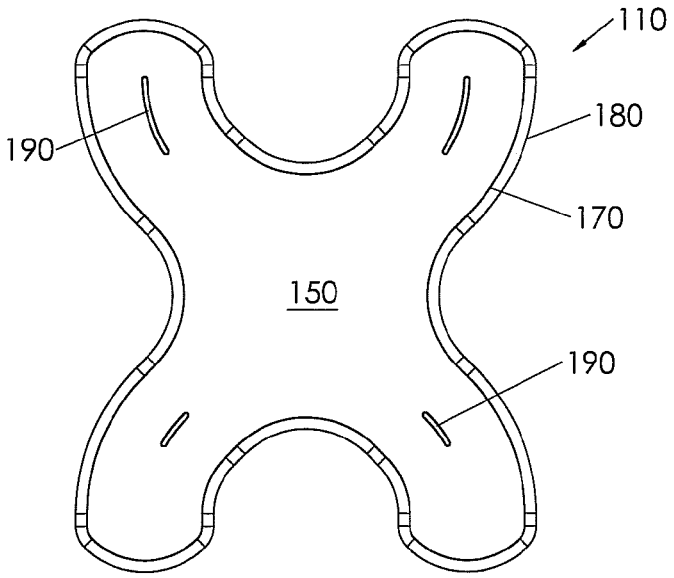
FIG. 5 is top view of a base of a furniture stabilization system, according to one or more examples of embodiments.
Figure 6:
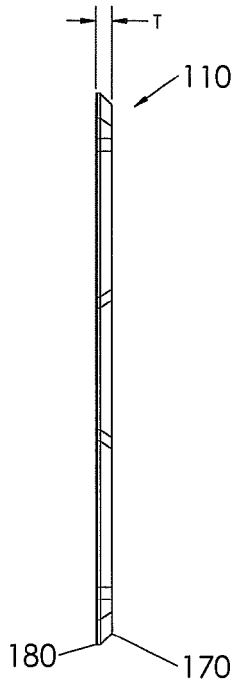
FIG. 6 is a side view of the base shown in FIG. 5, according to one or more examples of embodiments.
Figure 7:
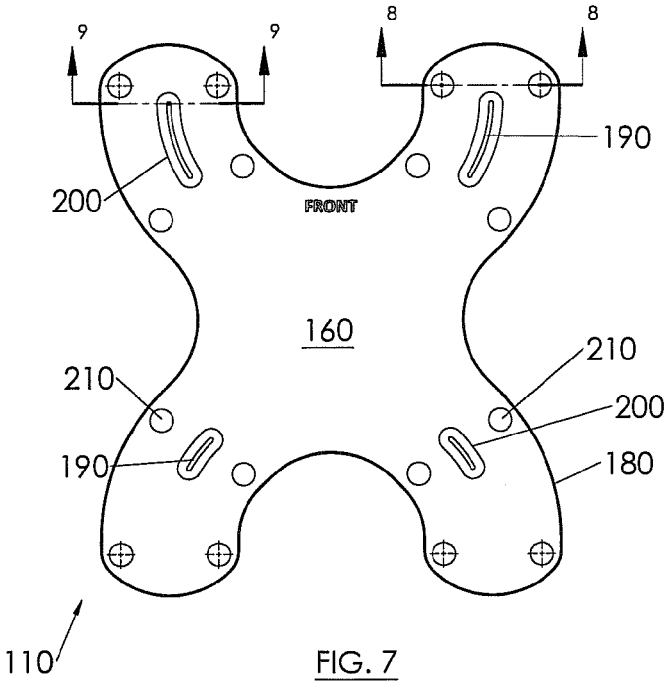
FIG. 7 is a bottom view of the base shown in FIG. 5, according to one or more examples of embodiments.
Figure 8:
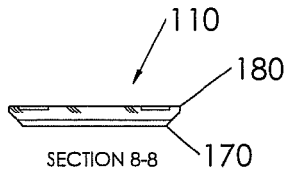
FIG. 8 is a section view of the base shown in FIG. 7, according to one or more examples of embodiments.
Figure 9:
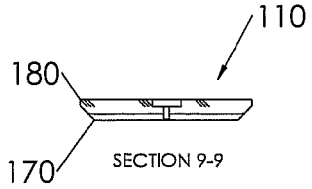
FIG. 9 is a section view of the base shown in FIG. 7, according to one or more examples of embodiments.
Figure 10:
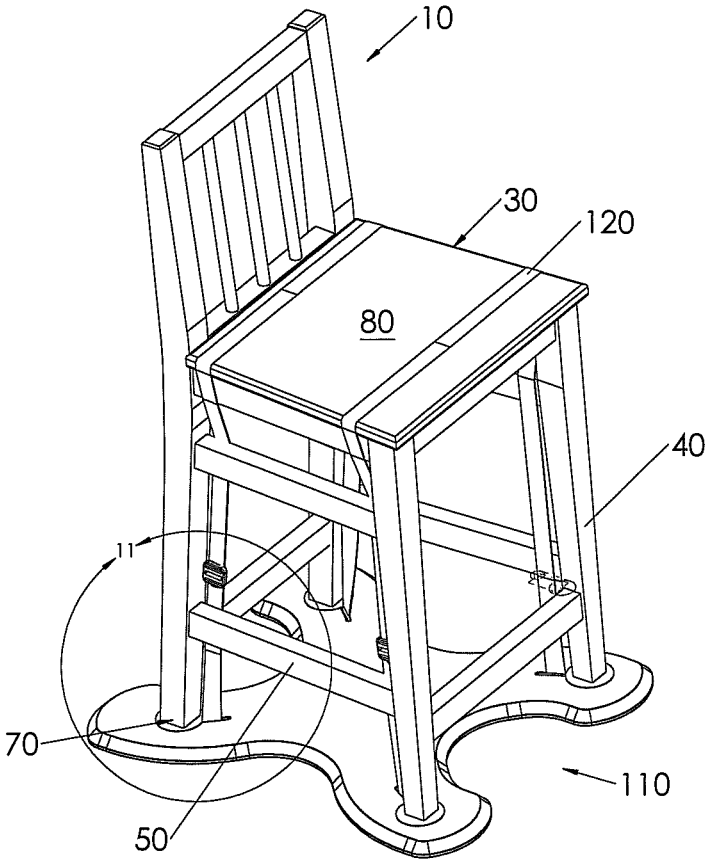
FIG. 10 is an isometric view of a furniture stabilization system and chair, according to one or more examples of embodiments.

In various embodiments, first strap 120 and/or second strap 130 are part of a first strap assembly 230 and/or second strap assembly 240, respectively. In various embodiments, first strap assembly 230 and/or second strap assembly 240 include a buckle 250 to help facilitate the adjustment and/or tensioning of first and/or second strap 120/130 to various pieces of furniture, chairs, seat base heights, and/or installations. It should be appreciated, however, that any device or mechanism for coupling (e.g., removably, releasably, or slidably coupling) portions of first strap 120 together and/or portions of second strap 130 together, including strap adjusters, buckles, side release buckles, cam buckles, center release buckles, slides, etc., may be used. As shown in FIGS. 3-4, in various embodiments, first strap assembly 230 and/or second strap assembly 240, also include a slide 260 or other buckle or device for receiving first and/or second straps 120/130 and helping operatively couple or otherwise secure first and/or second straps 120/130 to base 110.

As shown in FIGS. 3-4 and 10-11, in operation, chair 10 is provided on top surface 150 of base 110. In various embodiments, first strap 120 is threaded through slide 260 over or at least partially a top surface 80 of seat member 30 through another slide 260 and back over at least partially around a top surface 80 of seat member 30. In various embodiments, ends of first strap 120 are threaded into buckle 250 and tensioned to help hold base 110 to stool or chair 10. In various embodiments, second strap 130 is threaded through slide 260 over or at least partially around top surface 80 of seat member 30 through another slide 260 and back over or at least partially around top surface 80 of seat member 30. In various embodiments, ends of second strap 130 are threaded into buckle 250 and tensioned to help hold base 110 to chair or stool 10.

While shown as provided over top surface 80 or seat member 30, it should be appreciated that first and/or second straps 120/130 may be provided under or below seat member 30. For example, in various embodiments, first and/or second straps 120/130 may be provided through hardware (e.g., brackets) removably secured (e.g., using screws or other fasteners) or otherwise provided under seat member 30. In various embodiments, first and/or second straps 120/130 may be provided over, under, through or at least partially around one or more rungs 50, especially in cases where one or more of the rungs are structural.

Figure 11:
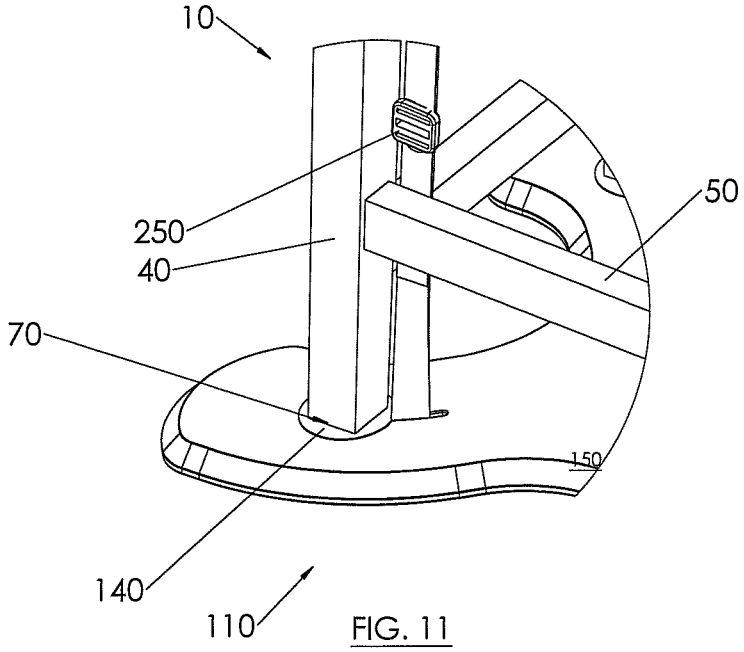
FIG. 11 is a detailed view of the furniture stabilization system and chair shown in FIG. 10, according to one or more examples of embodiments.

In various embodiments, one or more pads 140 are provided between distal ends or feet 70 of one or more of the leg members 40 and top surface 150 of base 110. In one or more examples of embodiments, members are provided between the distal ends or feet of the leg members and the top surface of the base to raise the height of the chair to a desired or predetermined height. In various embodiments, first and/or second straps 120/130 may be routed or threaded behind and/or inside one or more rungs 50 (e.g., to help hide straps 120/130 and/or help keep straps 120/130 in an installed and/or more secure position). However, one or more of the straps may be routed outside the rungs. As illustrated in FIG. 11, at least one end of one or more straps 120/130 may hang downward from buckle 250 to allow downward force to be applied to the straps 120/130. However, a loose end of one or both of the straps may be provided such that an upward force may be applied to tighten the straps. In various embodiments, one or more ends of straps 120/130 may be trimmed after installation (e.g., for a cleaner appearance).

While the Figures show straps for coupling (e.g., operatively coupling) base 110 and chair 10, it should be appreciated that there are a number of other ways for coupling the base and the chair. For example, the leg members may clamped or otherwise fastened or removably fastened to the base using fasteners such as screws or bolts and/or using clamps or other hardware.

Figure 12:
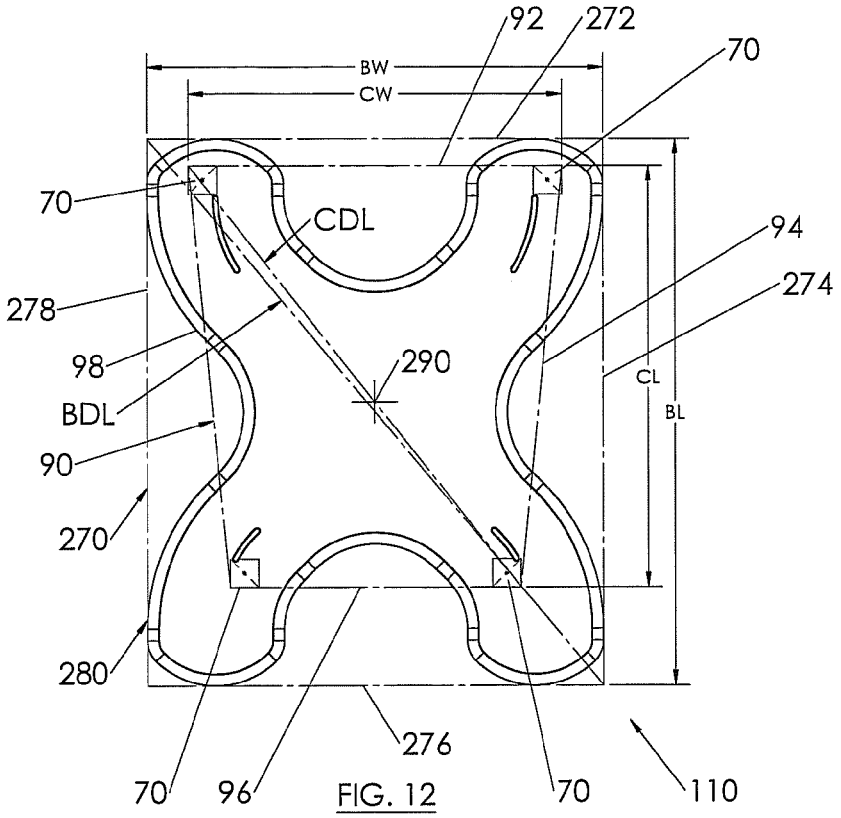
FIG. 12 is a sectional view of the feet of a piece of furniture provided on a top surface of a base of furniture stabilization system, according to one or more examples of embodiments.

In various embodiments, margins of base 110 define or help define a base footprint 270 as shown in broken lines in FIG. 12, and distal ends or feet 70 of each leg member 40 of chair 10 define or help define a chair footprint 90 as shown in broken lines running between distal ends 70 in FIG. 12. In various embodiments, base footprint 270 has a length "BL", a width "BW", and/or a diagonal length "BDL." In various embodiments, one or more of length BL, width BW, and/or diagonal length BDL is greater than one or more of a length "CL", a first (e.g., maximum) width "CW", and/or a diagonal length "CDL" of a chair footprint 90. In various embodiments, length BL is from about four to about twelve inches greater than length CL. In various embodiments, length BL is from about four to about six inches greater in dimension than length CL. In various embodiments, width BW is from about four to about eight inches greater than width CW. In various embodiments, width BW is approximately six inches greater than width CW.

In various embodiments, lower edge 180 of base 110 defines base perimeter 280. In various embodiments, base perimeter 280 is larger or longer than a perimeter of chair footprint 90. While base perimeter 280 is shown in FIG. 12 in the shape of an "X" (or elongated "X"), base perimeter 280 can be a variety of shapes, including, a "Y" (e.g., for furniture having three legs), a rectangle, a square, a circle, an oval, etc.

Figure 2:
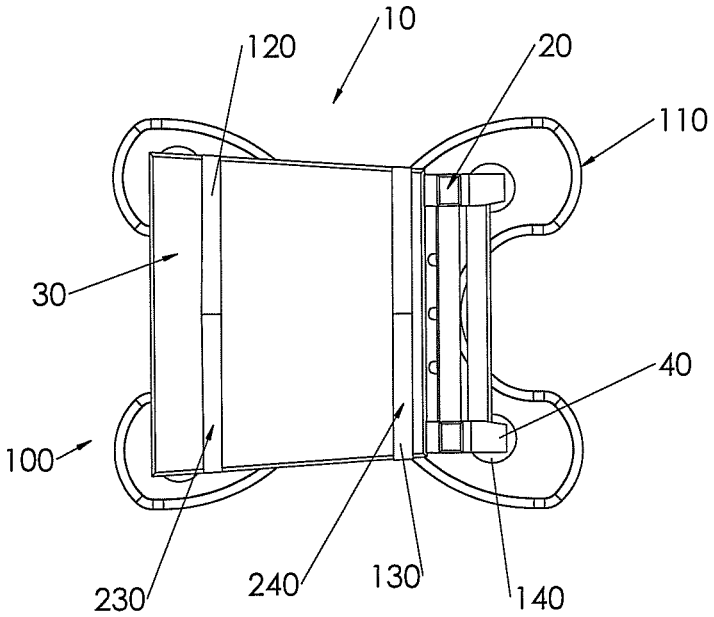
FIG. 2 is a top view of the furniture stabilization system and chair shown in FIG. 1.

In various embodiments, base perimeter 280 may not identically align with base footprint 270. For example, as shown in FIG. 2, base perimeter 280 may define a concave or scalloped features or profile at one or more of the sides of base 110. Such concave or scalloped features defined at one or more of the sides of base 110 provide a number of advantages. For example, such features or profile may help a user to place their foot in contact with the floor, while moving in or out of a chair operatively coupled to system 100. In addition, these features or profile also reduce the amount of material necessary for manufacturing base 110.

As shown in the Figures, when system 100 is coupled (e.g., removed by and or operatively) to chair 10, chair footprint 90 may not be exactly centered over base footprint 270. For example, in various embodiments, chair footprint 90 may be closer to a first side of base footprint 270 and further from an opposing second side of base footprint 270, for example, to make it less easy and/or more difficult to tip the chair around the opposing second side of base footprint 270, relative to the first side of base footprint 270.

In various embodiments, and as shown in FIG. 12, when coupled to furniture, system 100 outwardly extends, and/or effectively extends outwardly one of more tipping axes of the furniture. In various embodiments, margins of base 110 help define base tipping axes 272 274, 276 and 278, and distal ends or feet 70 of chair 10 help define chair tipping axes 92, 94, 96, 98. In various embodiments, one or more of base tipping axes 272, 274, 276 and/or 278 is farther from center 290 of base 110 than one or more chair tipping axes 92, 94, 96, 98. For example, in various embodiments, base tipping axis 272 is farther from center 290 than chair tipping axis 92, base tipping axis 274 is farther from center 290 than chair tipping axis 94, base tipping axis 276 is farther from center 290 than chair tipping axis 96, and/or base tipping axis 278 is farther from center 290 than chair tipping axis 98.

Figure 13:
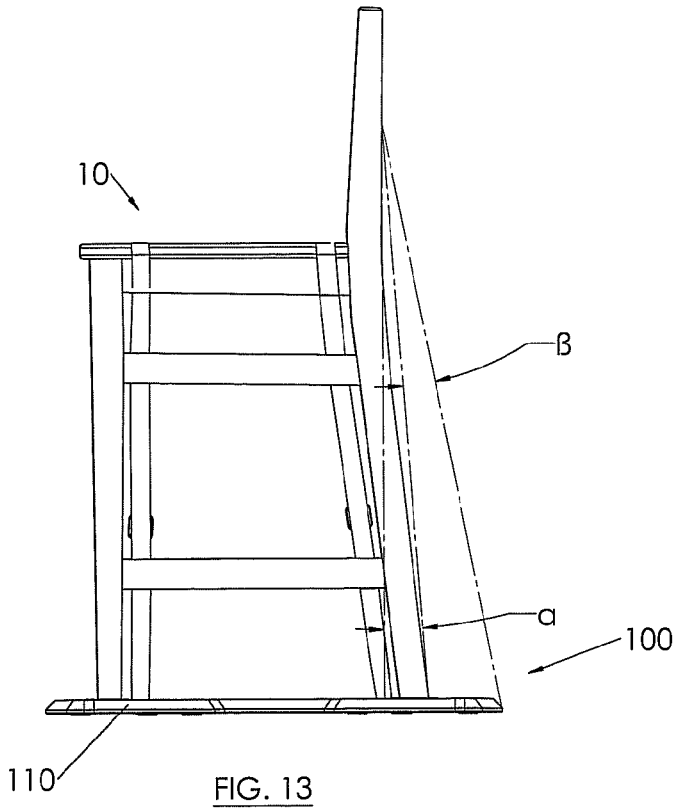
FIG. 13 is a side view of the furniture stabilization system and chair, according to one or more examples of embodiments.

In various embodiments, and as shown in FIG. 13, furniture stabilization system 100 increases resistance angle of stool or chair 10 coupled to the system. For example, chair 10 may have a tip resistance angle $\alpha$. In various embodiments, base 110 of furniture stabilization system 100 is dimensioned to increase tip resistance angle $\alpha$ by angle $\beta$. In various embodiments, angle $\beta$ is in a range of about four to about fifteen degrees. In various embodiments, angle $\beta$ is in a range of about five to about eleven degrees. In various embodiments, angle $\beta$ is in a range from about six to about nine degrees. In various embodiments, angle $\beta$ is approximately seven degrees.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

We claim:

1. A device for preventing the tipping of furniture having a first set of legs extending below a seat front portion of a seat member and a second set of legs extending below another portion of a seat member, the first set of legs having a first set of feet defining a first furniture tipping axis and a second set of legs having a second set of feet defining a second furniture tipping axis substantially parallel to the first furniture tipping axis, the device comprising:

a substantially planar base having a central axis extending lengthwise between a first base tipping axis and a second base tipping axis, and having a first surface defining an upper extent of the base; and a first strap coupled to the base and adapted to be provided around at least one component of said furniture supported on the first surface of the base such that a distance along the central axis of the base from the first base tipping axis to the first furniture tipping axis is less than a distance along the central axis of the base from the first base tipping axis to the second furniture tipping axis and less than or equal to a distance along the central axis of the base from the second furniture tipping axis to the second base tipping axis.

2. The device of claim 1, wherein the first strap is threaded through an aperture defined by the base.

3. The device of claim 1, further comprising a second strap coupled to the base and adapted to be provided around at least one component of said piece of furniture.

4. The device of claim 1, wherein the base has a second surface opposing the first surface, and pads are provided on the second surface to help the base slide on a floor.

5. The device of claim 1, wherein the base has an X-shaped base perimeter.

6. A furniture stabilization system, the system comprising:

a substantially planar base having a first surface, a center point, and a central axis extending lengthwise between a first base tipping axis and a second base tipping axis, the first surface defining an upper extent of the base and being adapted to support a piece of-furniture having a seat member with a seat front portion and a seat rear portion, a first set of legs extending below the seat front portion and a second set of legs extending below the seat rear portion, the first set of legs having a first set of feet defining a first furniture tipping axis and a second set of legs having a second set of feet defining a second furniture tipping axis; and a first strap coupled to the base and adapted to be removably provided at least partially around at least one component of said piece of furniture to retain the piece of furniture relative to the base such that the seat is directly over the center point of the base and the distance along the central axis of the base from the first base tipping axis to the first furniture tipping axis is less than a distance along the central axis of the base from the first base tipping axis to the second furniture tipping axis and less than or equal to a distance along the central axis of the base from the second furniture tipping axis to the second base tipping axis.

7. The furniture stabilization system of claim 6, wherein the first strap is threaded through an aperture defined by the base.

8. The furniture stabilization system of claim 6, further comprising a second strap coupled to the base and adapted to be removably provided at least partially around at least one component of said piece of furniture.

9. The furniture stabilization system of claim 6, wherein the first surface has a perimeter, and the base has a second surface having a perimeter greater than the perimeter of the first surface.

10. The furniture stabilization system of claim 6, wherein the base has a second surface opposing the first surface, and pads are provided on the second surface to help the base slide on a floor.

11. The furniture stabilization system of claim 6, wherein the base has an X-shaped base perimeter.

* * * * *